United States Patent [19]

Carney et al.

[11] Patent Number: 4,960,021

[45] Date of Patent: Oct. 2, 1990

[54] MEAT SLICER

[76] Inventors: Donald R. Carney, 320 Riverside Dr., Seaford, Del. 19973; Daniel Fisher, 200 Oak Ave., New Holland, Pa. 17557

[21] Appl. No.: 393,365

[22] Filed: Aug. 14, 1989

[51] Int. Cl.[5] ..... B26D 1/24

[52] U.S. Cl. ..... 83/120; 83/122; 83/155.1; 83/425.4; 83/435.2; 83/500

[58] Field of Search ..... 83/425.3, 425.4, 155.1, 83/434, 435, 418, 500, 122, 501; 17/52

[56] References Cited

U.S. PATENT DOCUMENTS

| | | | |
|---|---|---|---|
| 1,316,026 | 9/1919 | Gamage . | |
| 2,148,782 | 2/1939 | Spang . | |
| 2,241,648 | 5/1941 | Spang | 146/98 |
| 2,506,117 | 5/1950 | Stiefvater | 146/98 |
| 3,788,176 | 1/1974 | Glass | 83/114 |
| 3,841,186 | 10/1974 | Demerin | 83/425.4 |
| 3,990,336 | 11/1976 | Soodalter | 83/425.3 |
| 4,205,570 | 6/1980 | Soodalter | 83/425.3 |
| 4,313,963 | 2/1982 | Greenspan | 426/58 |
| 4,733,437 | 3/1988 | Nienstedt | 17/52 |

*Primary Examiner*—Frank T. Yost
*Assistant Examiner*—Kenneth E. Peterson
*Attorney, Agent, or Firm*—Hoffman, Wasson, Fallow & Gitler

[57] ABSTRACT

An apparatus for slicing meat into strips comprises a conveyor for transporting the meat beneath an array of spaced rotary cutting blades, which float upon their driveshaft, their spacing being maintained only by a stack of pressure wheels mounted on a freewheeling shaft parallel to the driveshaft. A free-floating wedge is confined between the conveyor surface, the cutter blades, and the pressure wheels, for separating the meat from the conveyor.

7 Claims, 2 Drawing Sheets

MEAT SLICER

BACKGROUND

This invention relates to the art of meat slicing, and in particular to a high-volume device of the rotary blade type for producing strips of meat from boned meat parts such as chicken breasts.

The many devices available today for slicing meat in volume are in general complex and therefore expensive to manufacture. As with this invention, numerous devices exist employing plural circular blades mounted upon, and spaced along, a common axis, to produce strips of meat. The meat portions may be passed to the blades by means of endless belt conveyors.

Prior inventors have addressed two problems peculiar to multiple-disc slicers: (a) that of forcing the meat cut toward, and thus between, the blades, and (b) that of preventing meat between the blades from remaining therebetween for a complete rotation of the blades, and thus accumulating in the apparatus.

One way of solving the first of the above problems is to position plural pressure wheels opposite the blades, the pressure wheels ordinarily having gaps between them which permit the peripheries of the cutting blades to enter, so that the blades and pressure wheels become somewhat interdigitated. Ordinarily, the pressure wheels and cutter blades are affixed on respective, parallel shafts at identical intervals, to insure that the blades and wheels will remain in proper lateral registration.

We have found that, by mounting the cutter blades and the pressure wheels loosely on their shafts, assembly, disassembly and cleaning are greatly facilitated, without detriment to the efficiency of the cutter. In fact, it appears that an apparatus so constructed is actually superior in performance to that of devices constructed with tighter fits. The components for our apparatus are also simpler to manufacture that in prior devices.

This invention also deals with the problem of separating the meat cuts from an endless conveyor, such as a horizontal belt used to transport the cuts from an upstream apparatus to the cutter blades. Under the action of both gravity and surface adhesion, the cuts tend to remain on the conveyor, and so it is necessary to encourage the meat cuts to stay with the blades until they are forced to do so by the pressure wheels just downstream of the conveyor. One approach in the past has been to make the conveyor actually a series of parallel webs, so that the cutting blades could penetrate between them; this approach, however, results in greater cleaning problems, and more opportunity for conveyor failures.

SUMMARY OF THE INVENTION

According to the present invention, the meat is separated from the conveyor surface by means of a floating, wedge-like element confined within the volume defined between the cutting blades, the pressure Wheels, and the conveyor belt surface. This element is confined only width-wise of the machine; otherwise, it can float up and down or back and forth, to adjust for irregularities in the belt surface. In addition, the wedge element is easily removed for cleaning.

An object of the invention is to provide the industry with a simple, reliable, and easy to clean apparatus for cutting meat into strips.

BRIEF DESCRIPTION OF THE DRAWINGS

In the accompanying drawings.

DESCRIPTION OF THE PREFERRED EMBODIMENT

Figure 1:
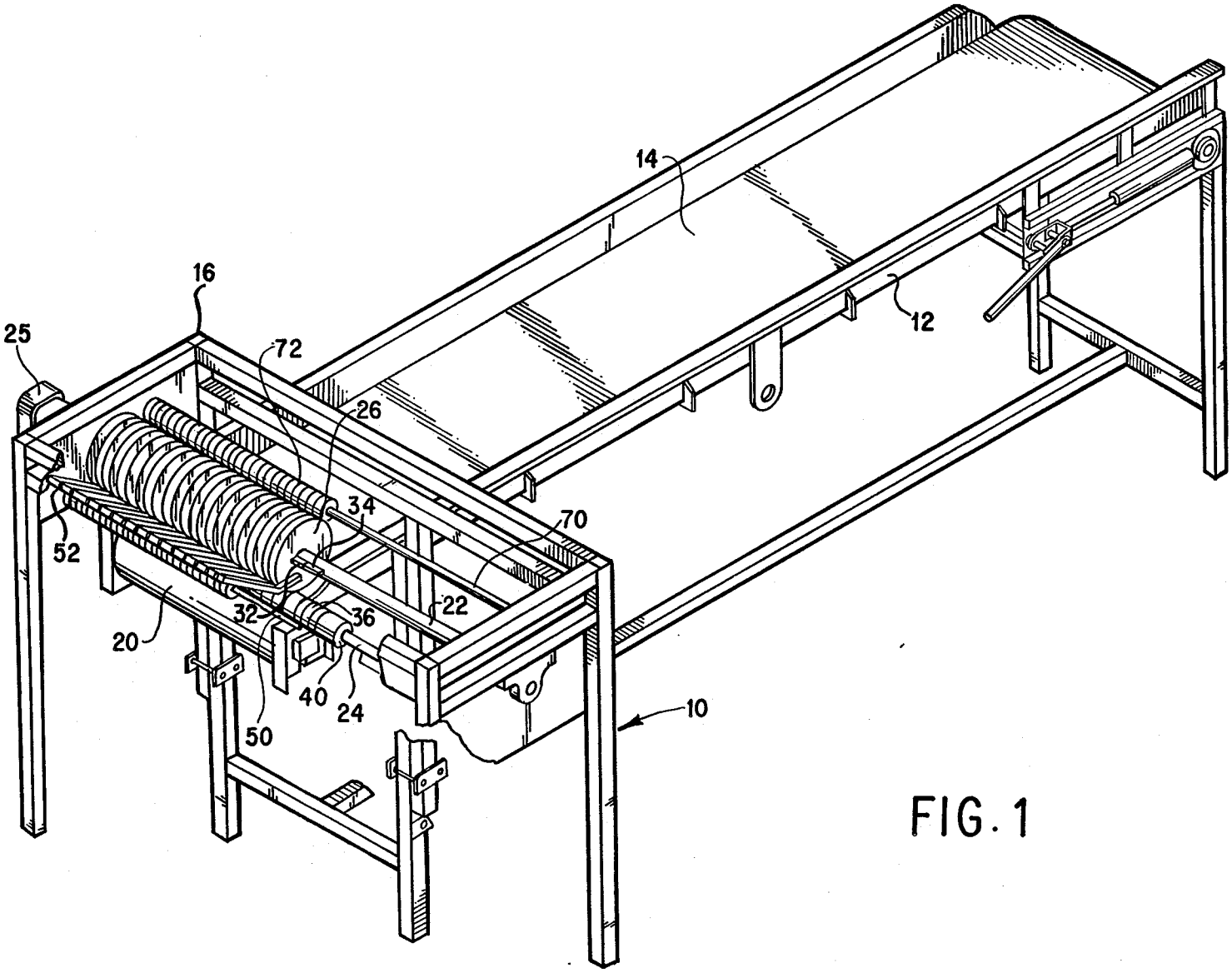
FIG. 1 is an isometric view of a meat slicer embodying the invention.
Figure 2:
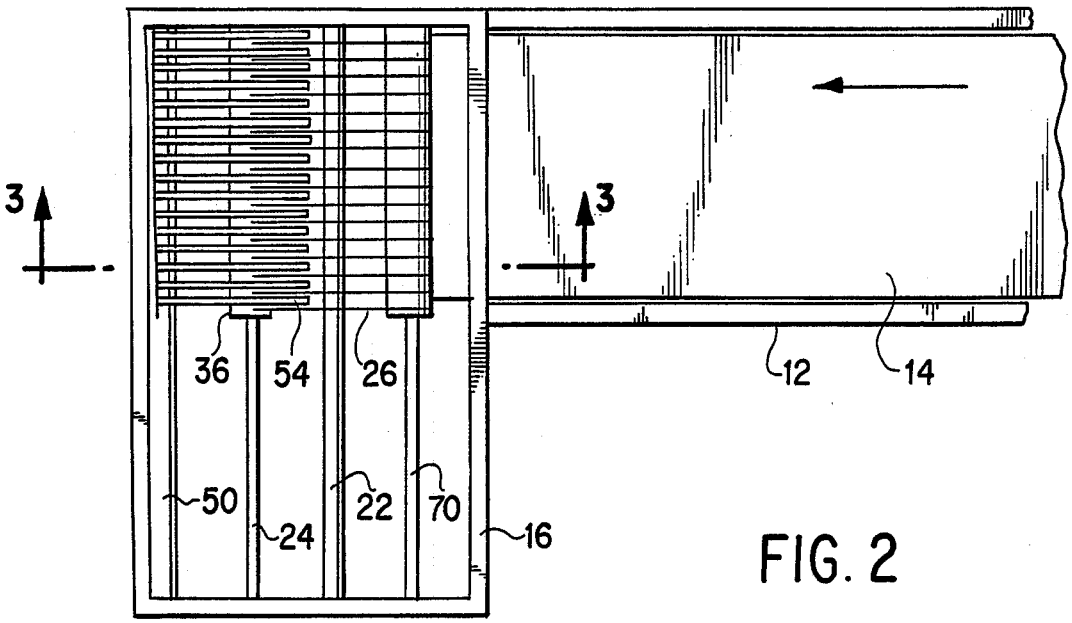
FIG. 2 is a top view thereof.
Figure 3:
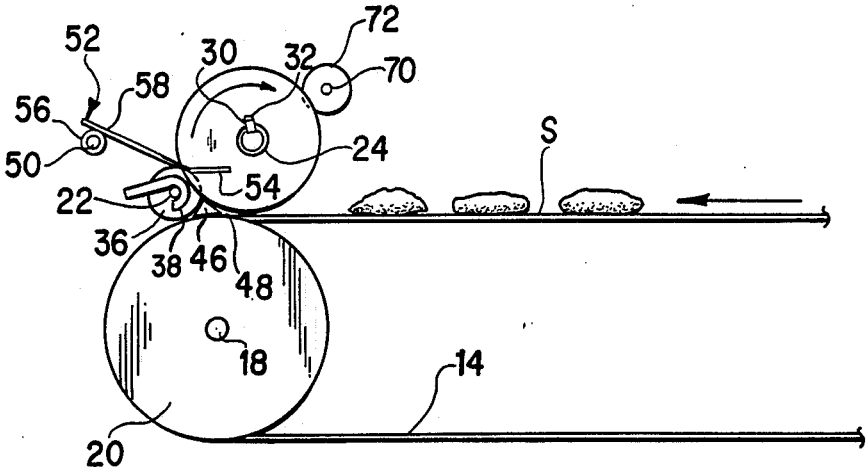
FIG. 3 shows internal details of the apparatus, in a cross-sectional view taken along the line 3—3 in FIG. 2.

FIGS. 1–3 depict a meat slicer embodying the invention. The apparatus shown includes a frame 10 including an inlet end portion 12 which supports an endless belt conveyor 14. The conveyor 14 has a plasticized surface of a material approved for meat packing plant use, and has runs from an upstream apparatus A (not part of the invention, and thus shown by phantom lines). The main portion 16 of the frame supports a horizontal shaft 18 FIG. 3, supporting a rotary cylinder 20 on which the downstream end of the conveyor 14 runs. Details of the conveyor are conventional, and are thus not described further.

The upper surface of the upper run of the conveyor belt is designated by the letter S. At the downstream end of the conveyor, shafts 22 and 24 are rotatably mounted on the frame portion 16, each extending parallel to the shaft 18. Shaft 24 is free to rotate, whereas shaft 22 is driven by a hydraulic motor 25 in a rotary direction opposite that of the conveyor cylinder 20.

Figure 4:
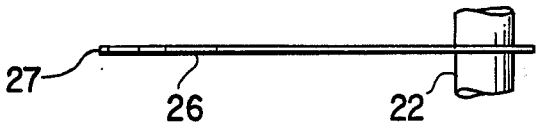

The shaft 22 supports a plurality of circular cutter blades or discs 26, whose peripheries approach, but do not quite touch, the surface of the conveyor. Each blade is preferably made from 16 gauge stainless steel, and has a squared peripheral edge 27, as shown in FIG. 4. The discs, free to float axially on the shaft, also have substantial radial clearance from the shaft 22. This clearance, coupled with the lack of axial restraints, makes it easy to disassemble the cutter assembly, and allows the blades to wobble somewhat on the shaft 22. Preferably, each blade 26 has a key slot 30 at its inner diameter, for receiving a common key 32 set in a keyway 34 in the shaft, so that the discs can be driven by the shaft.

Spacing between the cutter discs is maintained by pressure wheels 36, which are mounted on shaft 24, with sheet metal spacers 38 between them. Each of the spacers has a shape somewhat like a "J", the loop of the J providing a pivot point mounting against the shaft 24, and the leg thereof serving to prevent meat scraps and the like from accumulating in the small space between adjacent pressure wheels. The legs of the spacers engage a water pipe, described below, which keeps the spacers from rotating, so that the leading edge of the leg of the spacer scrapes away any debris from between the pressure wheels.

The stack of wheels and spacers is maintained in axial compression by a pressure plate 40 at one end of the shaft. The pressure plate is kept under a constant, adjustable loading force applied by compression springs not as shown. The loading bias can be changed by means of a screw and nut arrangement or other suitable.

Looking at FIG. 3, one can see that between the conveyor belt surface S, the cutting discs 26, and the pressure wheels, there is a small confined volume. This volume is very nearly filled by a triangular wedge element 46, which may float between the moving members to adjust for belt irregularities. The wedge is made from UHMW plastic, and its leading edge 48 is sufficiently sharp to separate the meat cuts from the belt surface. The wedge is confined only along its length (widthwise of the machine), by a member which can be removed so that the wedge can be simply slid out for cleaning or replacement.

A fourth shaft 50 is supported by the frame; this one, however, is fixed. A plurality of stripper members 52 are loosely mounted on this shaft. Each of the stripper members has a finger 54 which extends between a respective pair of blades to remove the meat strips therefrom, and a pivot portion 56 having a hole 58 therein which engages against the shaft. The weight of the finger normally keeps each stripper member resting on top of the pressure wheel just below it.

A water pipe 60, in communication with a source of water under pressure, extends behind the shaft 50 for the width of the machine. The pipe (not shown) has perforations 62 at intervals, forming nozzles directed between the blades to remove debris therefrom. A trough 64 attached to the frame below the cutter blades, catches water and scraps and delivers them to an outlet, not shown.

A fifth shaft 70 may be affixed to the frame, diametrically across the blades 26 from the cutter wheels, with a series of UHMW spacer rings fixed at intervals on the shaft to act as guides for controlling the spacing between the cutter blades at that point. Such an arrangement does not appear to be necessary, however, and is considered optional.

In operation, meat cuts are placed, manually or mechanically, on the surface S of the conveyor belt 22. The conveyor, driven by the cylinder, carries the cuts to the region of the blades, rotating in unison with the pressure wheels. The meat is cut partially through by the blades while it is still on the conveyor, since there is little clearance between the two. Presently, it engages the leading end of the wedge member, and is forced to follow not the conveyor, but instead the cutting blades, to the region of the pressure wheels. These wheels, incidentally performing the function of axially locating the cutter blades, force the meat against and between the blades, shearing the remaining unsevered tissue, and producing a series of neatly cut strips in parallel across the width of the machine. The strips are removed from between the cutting blades by the fingers of the stripper members, whose weight is ordinarily sufficient to maintain the fingers in position. Should a particularly stubborn mass become lodged between a pair of the blades, however, the fingers may pivot upwards, against their gravity bias, to permit the mass to remain between the blades, for subsequent removal by other means.

In the event of a mechanical problem, or when it becomes necessary to clear the equipment or replace parts, it is a simple matter to release the loading on the pressure plate, and the spread out the cutter blades, pressure wheels, and stripper members along the lengths of their shafts, which are provided in considerable extra length to permit such movement.

While the machine described above has been designed specifically to julienne chicken parts, the invention could be put to other uses, perhaps with minor modification within the skill of the artisan. For example, it could be used to cut other types of meat, or certain fruits and vegetables. It may also prove useful for cutting non-food items.

Inasmuch as the invention is subject to various modifications and changes in detail, the foregoing should be regarded as only illustrative of the invention defined by the following claims.

I claim:

1. An apparatus for cutting meat into strips, comprising a frame, a conveyor belt, having an upper surface for moving meat cuts placed thereon, a driveshaft mounted for rotation on said frame, parallel to and above said conveyor belt surface, a plurality of circular cutter blades mounted at intervals along said driveshaft, said blades having peripheries spaced slightly above said belt surface, a second, rotatable shaft supported by said frame and extending parallel to the driveshaft, a plurality of pressure wheels mounted on said shaft, said pressure wheels being of such diameter as to extend slightly between adjacent of said cutter blades, so as to maintain spacing between the blades, said belt surface, said cutter blades, and said pressure wheels defining a volume therebetween, and a wedge element confined within said volume, said element being free to float within said volume, said wedge having a leading edge for separating meat from the conveyor surface.

2. The invention of claim 1, further comprising means for applying a compressive, axial force to said pressure wheels along said shaft.

3. The invention of claim 1, further comprising a plurality of spacers between said pressure wheels, said spacers having a width slightly greater than that of said cutter blades.

4. The invention of claim 1, wherein said cutter blades have squared peripheral edges.

5. The invention of claim 1, further comprising means for rotating said driveshaft, and wherein each of said blades is keyed to said driveshaft.

6. The invention of claim 1, further comprising a third shaft affixed to said frame and a plurality of individual strippers pivotally mounted on said shaft, for removing meat from between said cutter blades.

7. The invention of claim 1, further comprising a fourth shaft affixed to said frame, and a plurality of spacer rings mounted along said shaft, for maintaining spacing between said cutter blades, said fourth and second shafts being on approximately diametrically opposite sides of said driveshaft.

* * * * *